United States Patent [19]

Di Paola

[11] Patent Number: 4,925,098

[45] Date of Patent: May 15, 1990

[54] UNDERGROUND-INSTALLABLE ROTARY SPRAY IRRIGATOR DEVICE, WITH EMISSION ANGLE SELECTABLE FROM THE TOP

[75] Inventor: Jan C. Di Paola, Rome, Italy

[73] Assignee: James Hardie Irrigation (Italy), Fiano Romano RM, Italy

[21] Appl. No.: 293,501

[22] Filed: Jan. 4, 1989

[30] Foreign Application Priority Data

Jan. 29, 1988 [IT] Italy ..... 47576 A/88

[51] Int. Cl.[5] ..... B05B 3/16; B05B 15/10

[52] U.S. Cl. ..... 239/205; 239/206; 239/240; 239/242

[58] Field of Search ..... 239/203–206, 239/237, 240–242

[56] References Cited

U.S. PATENT DOCUMENTS

| | | | |
|---|---|---|---|
| 1,864,892 | 6/1932 | Coles et al. | 239/242 |
| 3,934,820 | 1/1976 | Phaup | 239/240 |
| 4,201,344 | 5/1980 | Lichte | 239/242 |
| 4,253,608 | 3/1981 | Hunter | 239/242 |
| 4,624,412 | 11/1986 | Hunter | 239/240 |
| 4,773,595 | 9/1988 | Livne | 239/242 |

*Primary Examiner*—Andres Kashnikow
*Assistant Examiner*—Karen B. Merritt
*Attorney, Agent, or Firm*—Laurence R. Brown; Alfred J. Mangels

[57] ABSTRACT

The invention relates to an underground-installable spray irrigator device with a piston-type spray element raisable and rotatable by the pressure of the irrigation water, comprising a turbine which is rotated by the water pressure to rotate the rotatable portion of the piston spray element by way of a reduction gear, wherein the turbine is fed by feed means which are oriented obliquely to the turbine axis is such a manner as to provide the same direction of rotation, and are mobile between two stable positions in which they are orientated in opposite directions, they being connected, by a shaft coaxial to the turbine and to the casing of the device, to a rotation reversal member which is disposed at the top of the spray element and comprises striker means which are accessible directly from the upper region of the device and are adjustable in position to set the size of the spray angle.

5 Claims, 4 Drawing Sheets

UNDERGROUND-INSTALLABLE ROTARY SPRAY IRRIGATOR DEVICE, WITH EMISSION ANGLE SELECTABLE FROM THE TOP

This invention relates to an underground-installable spray irrigator device with a piston-type spray element raisable and rotatable by the pressure of the irrigation water and with its width of spray adjustable from the top.

Underground-installable spray irrigators have been known for some time in which their body, connected to a water feed pipe, comprises a telescopic spray element mobile vertically under the thrust of the water to position the spray nozzle at a level above the outer casing, to allow free outflow.

Such known irrigators can also be provided with turbine-operated rotation members which by utilising the thrust of the irrigation feed water cause the spray element to rotate through a predetermined angle and reverse its direction of rotation at the ends of this angle.

However, known irrigators of this type have their spray angle adjustment device disposed in the region below the piston and it is therefore not possible, when the device is not operating, to know the selected spray angle without removing the irrigator element.

Furthermore, known reversal devices substantially limit the width of the adjustment range because they require a relatively large angle for operating the reversal mechanism.

There is therefore the problem of providing an underground-installable irrigator device with its spray element raisable and rotatable, in which the selected size of spray angle can, when the device is installed, be seen by directly viewing its upper part and is easily adjustable without having to dismantle the device, and which moreover has no limitation on the selection of the spray angle.

These results are attained according to the present invention by an underground-installable spray irrigator device with a piston-type spray element raisable and rotatable by the pressure of the irrigation water, comprising a turbine which is rotated by the water pressure to rotate the rotatable portion of the piston-type spray element by way of a reduction gear, wherein the turbine is fed by feed means which are orientated obliquely to the turbine axis in such a manner as to provide the same direction of rotation, and are mobile between two stable positions in which they are orientated in opposite directions, they being connected, by a shaft coaxial to the turbine and to the casing of the device, to a rotation reversal member which is disposed at the top of the spray element and comprises striker means which are accessible directly from the upper region of the device and are adjustable in position to set the size of the spray angle.

The feed means for the turbine, disposed below this latter, comprise a lower plate carrying one or more nozzles of vertical axis parallel to the axis of the turbine and spaced radially from it, above them there being disposed a conveyor disc provided, in correspondence with each nozzle, with a pair of ducts which open upperly towards the turbine and have their axes oblique to the turbine axis in directions which produce mutually opposite directions of rotation of the turbine, the conveyor disc being rotatable between two positions, in which it makes one or other of the oblique ducts of each pair face the corresponding nozzle, a bistable elastic means being provided to maintain its assumed position, the conveyor disc also being connected to turn with the rotation reversal member at the top of the spray element.

The rotation reversal member disposed at the top of the spray element comprises a pair of superposed coaxial rings rotated rigidly with the upper portion of the spray element and provided with respective striker teeth with which at the ends of the selected angle of rotation there comes into contact a blade rigid with the connection shaft to the turbine feed means, the contact between the blade and one of the striker teeth causing the blade and the turbine feed means to be dragged from a position in which the turbine is rotated in one direction to a position in which the turbine is rotated in the opposite direction.

The coaxial rings of the reversal member are provided with peripheral toothing with which they separately engage two respective pinions which can be manually rotated through apertures corresponding to them in the top cover of the spray element, and through which the relative angular position of the ring striker teeth can be freely selected.

The top cover of the spray element is constructed of transparent material to enable the position of the striker teeth and of the blade engageable with them to be seen.

Further details will be apparent from the detailed description of a preferred embodiment of the device according to the invention given hereinafter with reference to the accompanying drawings in which.

Figure 1:
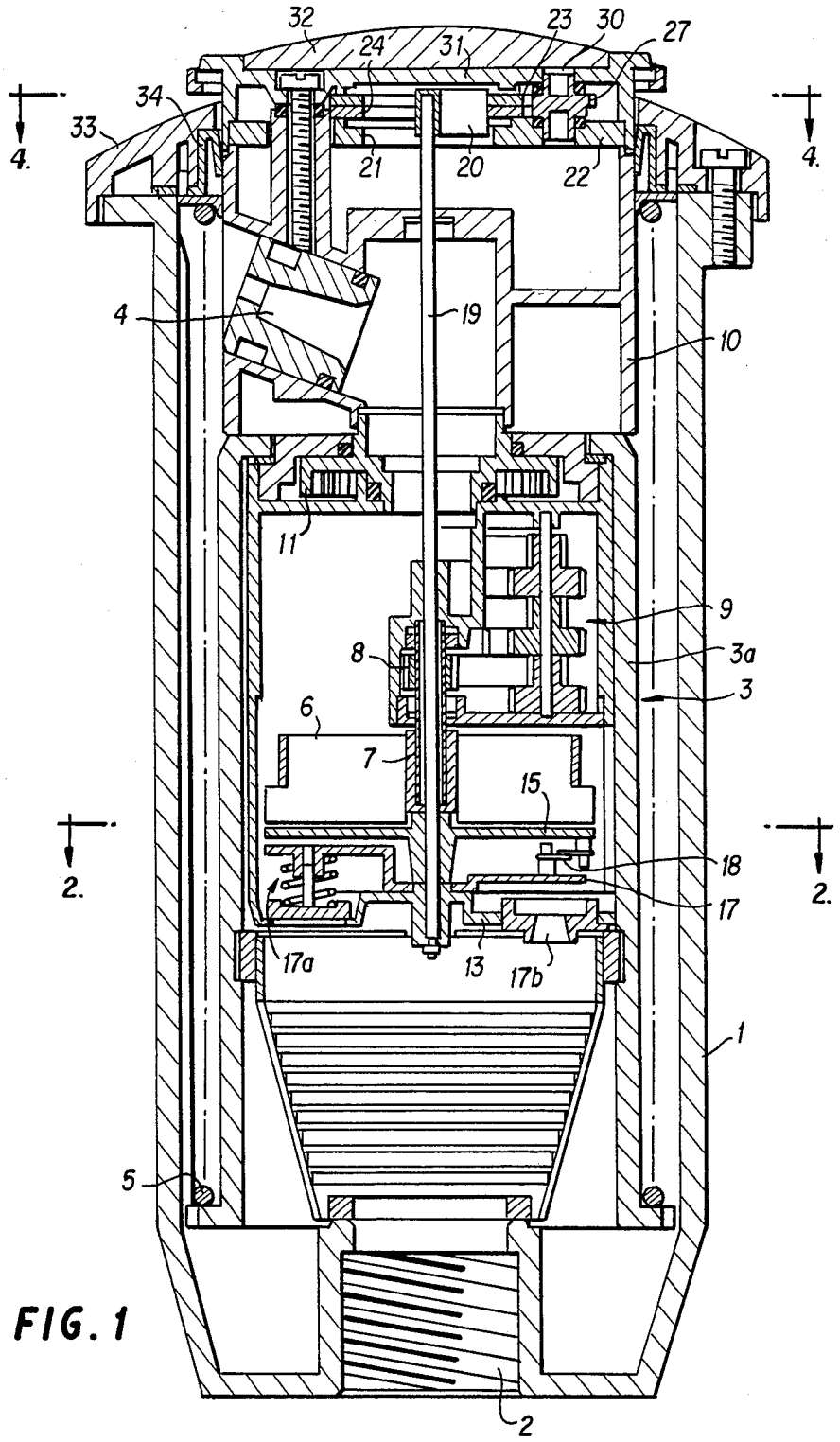
FIG. 1 is an axial section through the irrigator according to the invention in its rest position.

As shown in the figures, the irrigator according to the invention comprises substantially an outer casing 1 which can be connected to a branch of an irrigation main, not shown, by a relative threaded connector 2 or the like. Inside the casing 1 there is a slidable element, indicated overall by 3 and carrying a spray nozzle 4, and arranged to rise under the thrust of the irrigation water pressure to move the nozzle 4 outside the casing 1 against the action of a return spring 5 interposed between the casing 1 and the element 3.

Inside the element 3 there is a turbine 6 rigid with a tubular shaft 7, on which there is fixed a gear 8 which in its turn engages with a reduction gear unit 9 which rotates, at less than the speed of the turbine, the upper portion 19 of the slidable element 3 to which the nozzle 4 is fixed by means of the toothed cap 11.

The reduction gear unit 9 can be of any known type and is therefore not described further.

Figure 2:
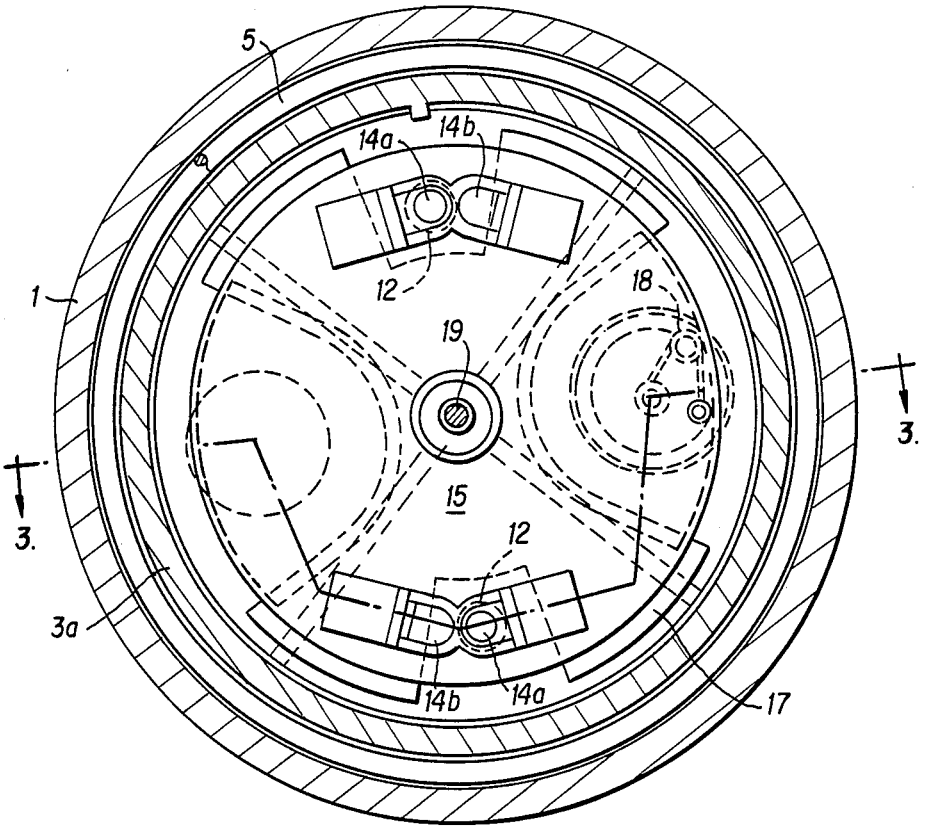
FIG. 2 is a section on the line II—II of FIG. 1.
Figure 3:
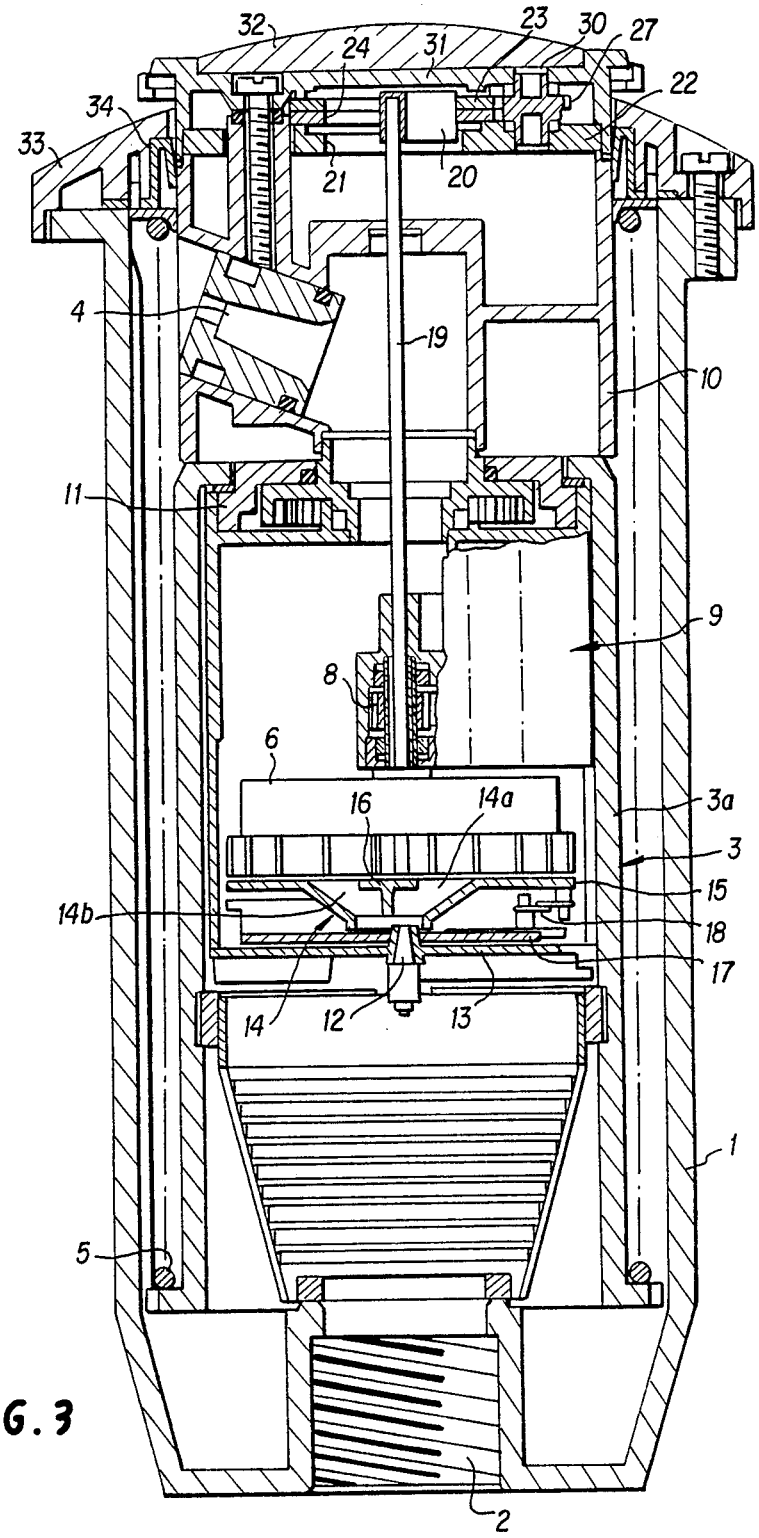
FIG. 3 is a section on the line III—III of FIG. 2.

As show in FIGS. 2 and 3, the feed to the turbine 6 is provided by way of a pair of opposing nozzles 12 on a lower plate 13 torsionally fixed inside the casing 3*a* of the element 3, in which the recduction gear unit 9 is housed. The plate 13 extends substantially over the whole of the interior of the element 3 and is rigid with it. The nozzles 12 communicate with the conveying ducts 14 of a swivel plate 15.

As shown in FIG. 3 the ducts 14 are each shaped with two passages 14*a*, 14*b* separated by a dividing baffle 16, to orientate their passing flow in a direction oblique to the axis of the turbine 6. As shown in FIG. 2, the nozzles 12 are disposed in correspondence with the pair of passages 14*a* or 14*b* which generate oblique flows producing the same direction of rotation of the turbine 6 about its axis.

The swivel plate 15 is connected by a bistable spring 18, having two stable positions such as to dispose the one or other of the pairs of passages 14*a* or 14*b* in correspondence respectively with the nozzles 12, to the intermediate plate 17 which is interposed between the former and the lower plate 13 and is rigid with this latter.

The relief valves 17*a*, 17*b* for excess hydraulic pressure are interposed between the plates 13 and 17.

Inside the tubular shaft 7 and coaxial to it there is a drive shaft 19 which is rotatable within the lower fixed plate 13 and is rigid with the swivel plate 15.

The shaft 19 extends coaxially to the irrigator casing as far as the top of this latter and carries a transverse blade 20 on its end.

The blade 20 lies within the circular aperture 21 in the top plate 22 of the irrigator, above which there are two superposed adjustment rings 23, 24 coaxial to the shaft 19, they surrounding the blade 20 and being toothed on their outer perimeter.

Figure 4:
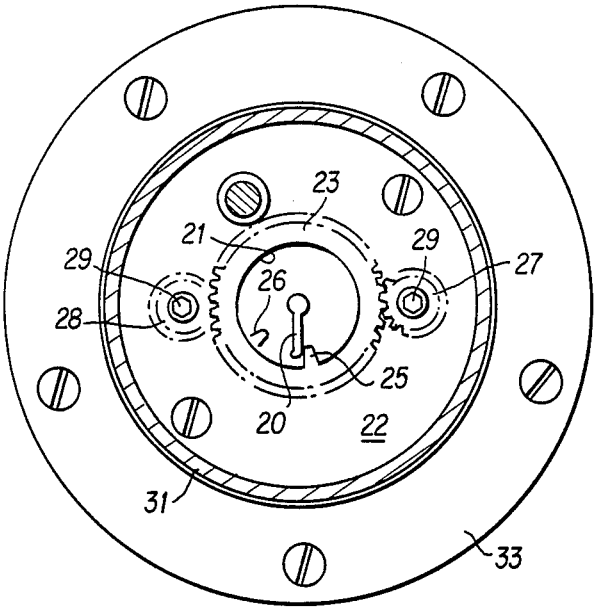
FIG. 4 is a section on the line IV—IV of FIG. 1.

As can be seen in FIG. 4, each of the rings 23, 24 possesses an inner tooth indicated respectively by 25 and 26 and projecting sufficiently to interfere with the radial extension of the blade 20.

In symmetrical positions the plate also carries a pair of pinions which engage with the rings 23, 24 respectively and are provided with a hexagonal socket 29 or similar gripping and rotating means accessible through a corresponding hole 30 in the upper cover 31 which upperly closes the entire assembly forming the slidable inner element 3.

The cover 31 is conveniently constructed of transparent material to enable the blade 20 and the rings 23 and 24 with their teeth 25, 26 to be seen through it. Above it there is provided a removable protection cap 32, for example of rubber.

An outer cap 33, provided with an inner hole and fixed to the casing 1 for example by screws closes it at its top to form the resting surface for the spring 5 and hold the gasket 34 which seals the outer wall of the element 3 at all times during its raising and rotation.

The irrigator according to the invention operates by raising the element 3 against the action of the spring 5 by the effect of the pressure of the water fed to it, so raising the nozzle 4 above the cap 33. The water feed flows through the nozzle 12 and, for example, through the ducts 14*a* to impinge obliquely against the radial blades of the turbine 6 to rotate it.

The turbine rotation is then transmitted by the reduction gear unit 9 to the cap 11 to rotate the upper portion 10 of the element 3.

During this rotation the shaft 19 rigid with the plate 15 remains at rest as does the blade 20.

During rotation when the tooth 25 (for example) strikes against the blade 20 it drags the blade and the plate 15 so that they rotate with it, to thus change their position, which is maintained by the bistable spring 18, so as to position the ducts 14*b* in front of the nozzles 12 and thus direct the flow to the turbine in the opposite direction to the preceding, therefore changing its direction of rotation.

In this manner the direction of rotation of the portion 10 of the element 3 is reversed, as is the direction of the spray emitted by the nozzle 4. This new direction of rotation is maintained until the tooth 26 comes into contact with the blade 20 to switch the position of the plate 15 and again position the ducts 14*a* in front of the nozzles 12 to restore the initial direction of rotation. The positions of the teeth 25, 26 therefore determine the irrigator spray angle between two successive reversals of motion. It is therefore particularly simple to set this angle by varying the positions of the rings 23, 24 by means of the pinions 27, 28, this being done simply by removing the protection cap 32 and operating through the top of the irrigator.

The cover 31, constructed of transparent material, also enables the relative positions of the teeth 25 and 26 to be seen, these corresponding to the reversal positions of the irrigator rotation, thus giving immediate vision of the set irrigator angle without having to totally or partly dismantle the irrigator.

The present invention has been described with reference to a preferred embodiment thereof given by way of non-limiting example, however modifications can be made thereto in practice by an expert of the art, but without leaving the scope of protection of the present invention.

I claim:

1. An underground-installable spray irrigator device with a piston-type spray element raisable and rotatable by the pressure of the irrigation water, comprising a turbine which is rotated by the water pressure to rotate the rotatable portion of the piston-type spray element by way of a reduction gear, wherein the turbine is fed in the lower part of the casing of the device by feed means which are orientated obliquely to the turbine axis in such a manner as to provide the same direction of rotation, and are mobile between two stable positions in which they are orientated in opposite directions, they being connected by a shaft coaxial to the turbine and to the casing of the device, to a rotation reversal member which is disposed at the top of the spray element and includes striker means which are accessible directly from the upper region of the device and are adjustable in position to set the size of the spray angle, wherein the feed means for the turbine, disposed below ths latter, include a lower plate carrying one or more nozzles of vertical axis parallel to the axis of the turbine and spaced radially from it, above them there being disposed a conveyor disc provided, in correspondence with each nozzle, with a pair of ducts which open upperly towards the turbine and have their axes oblique to the turbine axis in directions which produce mutually opposite directions of rotation of the turbine, the conveyor disc being rotatable between two positions, in which it makes one or other of the oblique ducts of each pair face the corresponding nozzle, a bistable elastic means being provided to maintain its assumed position, the conveyor disc also being connected to turn with the rotation reversal member at the top of the spray element.

2. An underground-installable spray irrigator device as claimed in claim 1, wherein the spray element includes a top cover that is constructed of transparent material to enable the position of the striker teeth and of the blade engageable with them to be seen.

3. An underground-installable spray irrigator device with a piston-type spray element raisable and rotatable by the pressure of the irrigation water, comprising a turbine which is rotated by the water pressure to rotate the rotatable portion of the piston-type spray element by way of a reduction gear, wherein the turbine is fed in the lower part of the casing of the device by feed means which are orientated obliquely to the turbine axis in such a manner as to provide the same direction of rotation, and are mobile between two stable positions in which they are orientated in opposite directions, they being connected by a shaft coaxial to the turbine and to the casing of the device, to a rotation reversal member which is disposed at the top of the spray element and includes striker means which are accessible directly from the upper region of the device and are adjustable in position to set the size of the spray angle, wherein the rotation reversal member disposed at the top of the spray element includes a pair of superposed coaxial rings rotated rigidly with the upper portion of the spray element and provided with respective striker teeth with which at the ends of the set angle of rotation there comes into contact a blade rigid with the connection shaft to the turbine feed means, the contact between the blade and one of the striker teeth causing the blade and the turbine feed means to be dragged from a position in which the turbine is rotated in one direction to a position in which the turbine is rotated in the opposite direction.

4. An underground-installable spray irrigator device as claimed in claim 3, wherein the coaxial rings of the reversal member are provided with peripheral toothing with which there separately engage two respective pinions which can be manually rotated through apertures corresponding to them in the top cover of the spray element, and through which the relative angular position of the ring striker teeth can be freely selected.

5. An underground-installable spray irrigator device as claimed in claim 4 wherein the spray element includes a top cover that is constructed of transparent material to enable the position of the striker teeth and of the blade engageable with them to be seen.

* * * * *